US007859407B2

(12) United States Patent
Hall et al.

(10) Patent No.: US 7,859,407 B2
(45) Date of Patent: Dec. 28, 2010

(54) WIDE EXIT/ENTRANCE ELECTRONIC ARTICLE SURVEILLANCE ANTENNA SYSTEM

(75) Inventors: Stewart E. Hall, Wellington, FL (US); Richard Copeland, Lake Worth, FL (US); William Farrell, West Palm Beach, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 364 days.

(21) Appl. No.: 12/223,770

(22) PCT Filed: Feb. 21, 2006

(86) PCT No.: PCT/US2006/006363

§ 371 (c)(1),
(2), (4) Date: Aug. 8, 2008

(87) PCT Pub. No.: WO2007/097752

PCT Pub. Date: Aug. 30, 2007

(65) Prior Publication Data

US 2009/0045954 A1 Feb. 19, 2009

(51) Int. Cl.
*G08B 13/14* (2006.01)

(52) U.S. Cl. ..... 340/568.1; 340/572.4; 340/572.7; 340/572.8; 235/435; 235/439; 235/449; 235/450; 343/741; 343/742; 343/787; 343/788

(58) Field of Classification Search ..... 340/572.4, 340/572.7, 572.8; 235/435, 439, 449, 450; 343/741, 742, 787, 788
See application file for complete search history.

(56) References Cited

U.S. PATENT DOCUMENTS 5,459,451 A * 10/1995 Crossfield et al. ..... 340/572.7
6,396,455 B1 * 5/2002 Ely et al. ..... 343/788
7,091,858 B2 * 8/2006 Copeland et al. ..... 340/572.1

* cited by examiner

*Primary Examiner*—Tai T Nguyen

(57) ABSTRACT

An electronic article surveillance antenna system with wide interrogation zones has a number of core transceiver antennas with each connectable to a transmitter. The core transceiver antennas are adapted to be installed adjacent a ceiling of the wide interrogation zone and generate an interrogation signal into the wide interrogation zone. The core transceiver antennas each are connectable to a receiver to receive and detect a response signal from an electronic surveillance marker disposed in the wide interrogation zone. The system also has transceiver antenna coils with each connectable to the transmitter and adapted to be installed adjacent a floor of the wide interrogation zone. The transceiver antenna coils generate the interrogation signal into the wide interrogation zone and each is also connectable to the receiver to receive and detect the response signal from the electronic surveillance marker disposed in the wide interrogation zone.

22 Claims, 16 Drawing Sheets

WIDE EXIT/ENTRANCE ELECTRONIC ARTICLE SURVEILLANCE ANTENNA SYSTEM

BACKGROUND

1. Technical Field

The present disclosure relates to an electronic article surveillance (EAS) system. More particularly, the present disclosure relates to an EAS system for exciting an EAS marker in a wide exit/entrance environment.

2. Background of the Related Art

Electronic Article Surveillance (EAS) systems are detection systems that allow the identification of a marker or tag within a given detection region. EAS systems have many uses, but often are used as a security system. Such a security system is for preventing shoplifting, robbery and theft in stores or the removal of property in office buildings; however such systems have been extended to other areas. Such areas include monitoring consumer habits and inventory control. EAS systems come in many different forms and make use of a number of different technologies.

An EAS system includes an electronic detection unit, markers and/or tags, and a detacher or deactivator. The detection units can, for example, be formed as pedestal units, buried under floors, mounted on walls, or hung from ceilings. The detection units are usually placed in high traffic areas, such as entrances and exits of stores or office buildings. The markers and/or tags have special characteristics and are specifically designed to be connected to, or embedded in, merchandise or other objects sought to be protected. When an active marker passes through a marker detection region, the EAS system sounds an alarm, a light is activated, and/or some other suitable audible alert device is activated to indicate the removal of the marker from the prescribed area.

Common EAS systems use transceivers. Transceivers each transmit and receive signals, or are made of a discrete and separate transmitter and receiver. The transmitter or one transceiver is placed on one side of the detection region. The receiver or another transceiver is placed on the opposite side of the detection region. The transmitter produces a predetermined excitation signal in a marker detection region.

This detection region is usually formed at a checkout aisle or an exit, or at an entrance. When an EAS marker enters the detection region, the marker has a characteristic response to the excitation signal. The characteristic response is received and detected by the system.

The marker may respond to the signal sent by the transmitter by using a simple semiconductor junction, a tuned circuit with an inductor and capacitor, a soft magnetic strip or wire, or a vibrating resonator.

The receiver subsequently detects this characteristic response. By design, the characteristic response of the marker is distinctive. The response is not likely to be created by natural circumstances. Moreover, such other noise or other signals may be filtered out using an appropriate filtering device connected to the EAS system.

EAS systems are often called upon for coverage of a large detection area, such as larger retail, commercial or storage establishments. Such retail establishments are often located in a mall or other strip malls. Often the mall will have an opened exit. The exit is larger and wider that conventional store entrances and exits. The mall store entrance can sometimes cover the width of the mall store itself. Such relatively large detection areas require special design considerations.

The EAS system used for coverage should be carefully designed to avoid any gaps where there is little or no magnetic field through which an EAS marker might pass through undetected.

Simultaneously, such an EAS system should avoid false alarming. Such false alarming distracts workers. False alarms may be caused by markers attached to store inventory which may be displayed near or adjacent to the detection region. It has been observed that when conventional EAS antenna systems, typically formed of loop antennas, are used in openings wider than about two meters, detection performance begins to deteriorate making exits greater than two meters.

Wide mall store entrances/exits may need detection areas up to about six meters wide or more. Wide exits and wide entrances refer to exits/entrances having widths greater than or equal to about 2.0 meters.

Attempts at solutions to the wide entrance environment include adding additional antennas in the floor and/or ceiling. However, this is disfavored because of the expensive construction costs associated with such an installation in the floor and/or ceiling. Adding loop antennas in existing flooring causes many problems, as the floor must be torn up in order to install the loop antenna, then replaced.

Additionally, such EAS systems often have to be permanently installed into the store. If installation requires a retrofit into the existing space, often the store's normal operation may be disturbed during installation, i.e., the floor or ceiling will have to be opened for installation of the EAS system then fixed and restored. Thereafter, if a modification of the entrance or exit occurs, any alteration of the orientation or location of the EAS system is desired (such as if an exit becomes wider), a major amount of work may be required. It would be desirable to provide a modular EAS system that can be easily installed, removed or moved depending on changing store condition or configuration.

Accordingly, there is a need for an EAS system that eliminates one or more of the aforementioned drawbacks and deficiencies of the prior art.

SUMMARY

According to a first aspect of the present disclosure, it is an object of the present disclosure to provide an electronic article surveillance antenna system that has an interrogation zone configured to a wide entrance or exit being greater than 2.5 meters wide.

According to another aspect of the present disclosure, it is an object of the present disclosure to provide an electronic article surveillance antenna system that has a pick rate greater than 92 percent for a number of different orientations of an EAS marker.

According to another aspect of the present disclosure, it is an object of the present disclosure to provide an electronic article surveillance antenna system that has a number of transceivers on a ceiling and also has a number of transceivers beneath a floor but above a sub-floor.

According to still another aspect of the present disclosure, it is an object of the present disclosure to provide an electronic article surveillance antenna system that has a number of ferrite core transceivers being disposed end to end in a complementary location in or on the ceiling.

According to still yet another aspect of the present disclosure, it is an object of the present disclosure to provide an electronic article surveillance antenna system that has a number of thin wire loop antenna coil transceivers beneath a floor, but above a sub floor, with each of the wire loop antenna coil transceivers being spaced adjacent to one another by a distance.

According to still another aspect of the present disclosure, it is an object of the present disclosure to provide an electronic article surveillance antenna system that has a number of thin wire loop antenna coil transceivers beneath a floor, but above a sub floor, with each of the wire loop antenna coil transceivers having a wire loop antenna coil transmitter and a wire loop antenna coil receiver.

According to another aspect of the present disclosure there is provided an electronic article surveillance antenna system configured to a wide interrogation zones. The system has a number of core transceiver antennas with each connectable to a transmitter. The core transceiver antennas are adapted to be installed adjacent a ceiling of the wide interrogation zone and generate an interrogation signal into the wide interrogation zone. The core transceiver antennas each are connectable to a receiver that receives and detects a response signal from an electronic surveillance marker disposed in the wide interrogation zone. The system also has transceiver antenna coils with each connectable to the transmitter and that are installed adjacent a floor of the wide interrogation zone. The transceiver antenna coils generate the interrogation signal into the wide interrogation zone and each is connected to the receiver to receive and detect the response signal from the electronic surveillance marker disposed in the wide interrogation zone.

DESCRIPTION OF THE DRAWINGS

Other and further objects, advantages and features of the present disclosure will be understood by reference to the following specification in conjunction with the accompanying drawings, in which like reference characters denote like elements of structure and.

DETAILED DESCRIPTION OF THE EMBODIMENTS

The embodiments of the present disclosure will now be described herein in connection with a number of various embodiments. Those skilled in the art will recognize, however, that the features and advantages of the present disclosure may be implemented in a variety of configurations. It is understood, therefore, that the embodiments described herein are presented by way of illustration and not of limitation.

Figure 1:
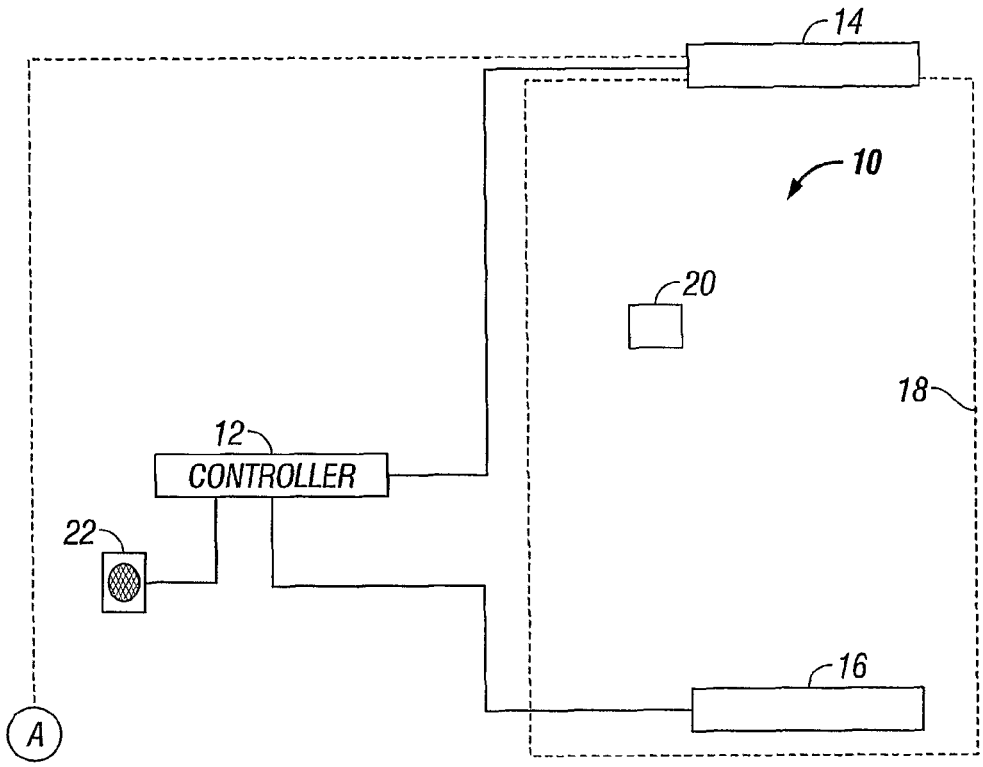
FIG. 1 is a schematic view of a first embodiment of an electronic article surveillance antenna system of the present disclosure.

Referring now to FIG. 1, there is shown a first simplified schematic of an embodiment of the present disclosure. FIG. 1 shows an electronic article surveillance antenna system generally designated as reference numeral 10 for generating a magnetic field to interrogate and detect electronic article surveillance markers.

The electronic article surveillance antenna system 10 has a controller 12 and a first antenna system 14. The first antenna system 14 is configured as a transceiver and the controller 12 is coupled to the transceiver in a wired manner by connection to leads or alternatively may be coupled in a wireless manner. The controller 14 includes proper control and switching capabilities to switch the first antenna system 14 between transmitting and receiving modes or functions at a predetermined time interval and is operatively connected to a transmitter (not shown) and a receiver (not shown). One in the art should appreciate that the transmitter and receiver may be integrated in the first antenna system 14 or be located remote therefrom and the present disclosure is not limited to any such arrangement.

The electronic article surveillance antenna system 10 may further have another or second antenna system 16 located on another side of an interrogation zone 18. The second antenna system 16 is likewise configured as another transceiver that may be the same as or different from the transceiver of the first antenna system 14. The controller 12 is connected to, and controls the second transceiver. The controller 12, likewise, includes proper control and switching circuitry to switch the second antenna system 16 between transmitting and receiving modes or functions at a predetermined time interval.

In wide applications or applications where the entrance or exit is wider than 2.0 or 2.5 meters, it has been observed that the antenna system becomes unreliable when the first antenna system 14 and the second antenna system 16 are positioned on either side of the entrance or exit. It is believed that the antenna systems 14 and 16 are too far apart from one another to properly interrogate or detect a marker 20 and the marker 20 may pass between the two antenna systems undetected and without any alarm. It is envisioned that the presently disclosed electronic article surveillance antenna system 10 resolves this problem as explained in more detailed below.

Electronic article surveillance markers 20 are typically placed by a manufacturer, librarian, office manager, or retailer on selected items, or assets that are desired to be protected from theft or that are desired to be tracked and monitored. Various types of electronic markers 20 are well known in the art and may be simply adhered, connected, or hidden in or on a desired item. If the marker 20 is not removed or deactivated at a counter prior to entry in to a defined interrogation zone 18, the magnetic field that is generated by the first and the second antenna systems 14, 16 will cause the marker to become saturated and then excited. The excited marker 20 will then signal the EAS system 10. The signal to the EAS system 10 can be received by the first and/or the second antenna systems 14, 16. The controller 12 will detect the EAS marker signal indicating the presence of the EAS marker 20 in the interrogation zone 18 and the controller may sound an audible alarm 22, pulse a light, send a message or take other audible or communicative action.

Wider entrances and exits (e.g., areas wider than two meters), are problematic to conventional EAS systems due to the inability of the EAS antennas to cover the entire entrance or exit particularly resulting in an unreliable system, i.e., the magnetic field and interrogation zone may not adequately extend across a wide area. Accordingly, conventional prior art EAS markers could conceivably pass through such a wide entrance or exit without detection, i.e., there may not be sufficient excitation of the marker 20 by the magnetic field, or the marker may be too far from the relevant antenna system in order for the antenna system to receive the signal from the excited marker. Attempts to boost power to increase the coverage of the magnetic field may have adverse and unintended consequences, e.g., exciting other stationary markers that are in the store thereby causing a so called "false" signal or other regulatory compliance issues.

A significant advantage of the presently discussed electronic article surveillance antenna system 10 is that the system 10 is specifically designed and configured for wide entrances and wide exits which range from about two to about six meters. The first antenna system 14 and the second antenna system 16 each include a number of transceivers that are spaced apart from one another, and which are controller by the controller 12 such that antenna systems 14 and 16 cooperate with one another in a suitable manner to provide an interrogation zone 18 which is complementary in size to the width of exit/entrance as explained below with respect to the various embodiments shown in FIGS. 3 through 13.

Figure 2:
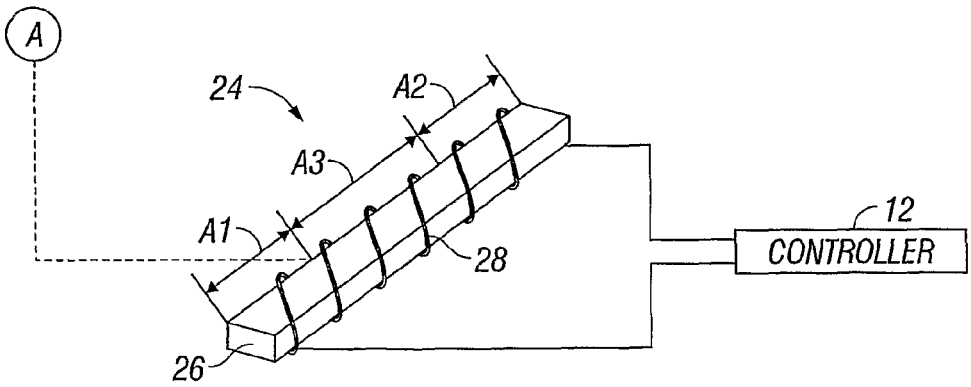
FIG. 2 is another schematic view of a core antenna of the electronic article surveillance antenna system being connected to a controller.

Referring now to FIG. 2, there is shown a perspective view of a core antenna 24. The core antenna 24 (by itself or with other similar core antennas) may be used with either the first or second antenna systems 14, 16 of the EAS system 10. The core antenna 24 has a core of material 26 with a winding 28 being disposed therearound in a number of turns. The winding 28 is connected to the controller 12. When the core antenna 24 is acting as a transmitter, a drive current is disposed through the windings 28 to generate the desired magnetic field in the interrogation zone 18 in a general orthogonal direction. The core antenna 24 also acts as a receiver and can detect a characteristic response signal from the electronic article surveillance marker 20 and is switched by the current in the coil winding 28 between the transmitter and the receiver modes or functions. Such a core antenna 24 is known and described in U.S. patent application Ser. No. 10/037,337 to Copeland, which is herein incorporated by reference in its entirety. Some other related patent applications include U.S. patent application Ser. No. 10/341,824 to Copeland, et al., filed on Jan. 14, 2003 which claims priority to U.S. Provisional Patent Application Ser. No. 60/478,944 filed on Jun. 16, 2003; U.S. patent application Ser. No. 10/854,877 to Copeland, et al., filed on May 27, 2004 which is a continuation-in-part of U.S. patent application Ser. No. 10/341,824 filed on Jan. 14, 2003; U.S. patent application Ser. No. 10/855,203 to Hall, et al., filed on May 27, 2004 which claims priority to U.S. Provisional Patent Application Ser. No. 60/478,943 filed on Jun. 16, 2003; U.S. patent application Ser. No. 10/847,752 to Hall, et al, filed on May 18, 2004 which claims priority to U.S. Provisional Patent Application Ser. No. 60/478,942 filed on Jun. 16, 2003 which are all herein incorporated by reference in their entirety.

Figure 3A:
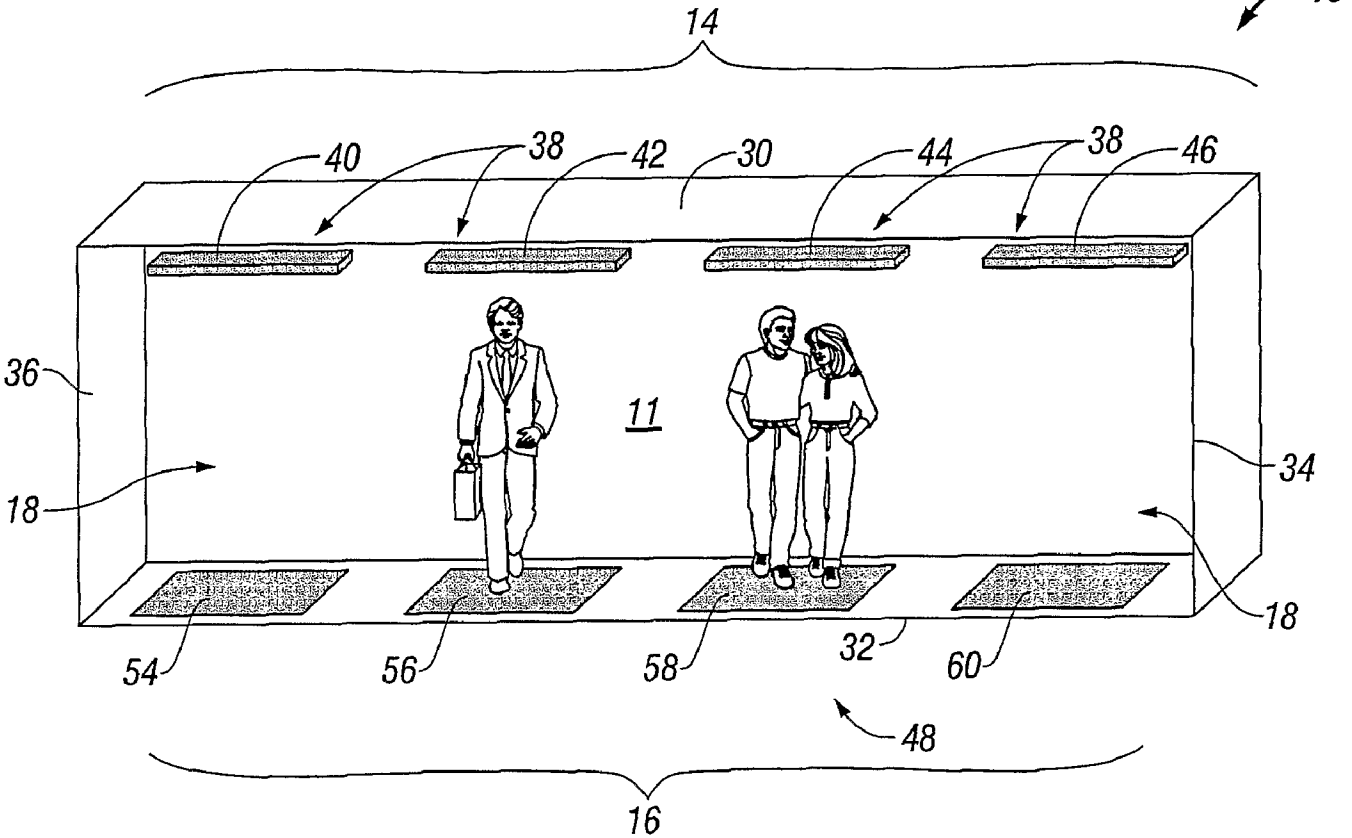
FIG. 3A is a perspective view of the electronic article surveillance antenna system for a wide entrance/exit.
Figure 3B:
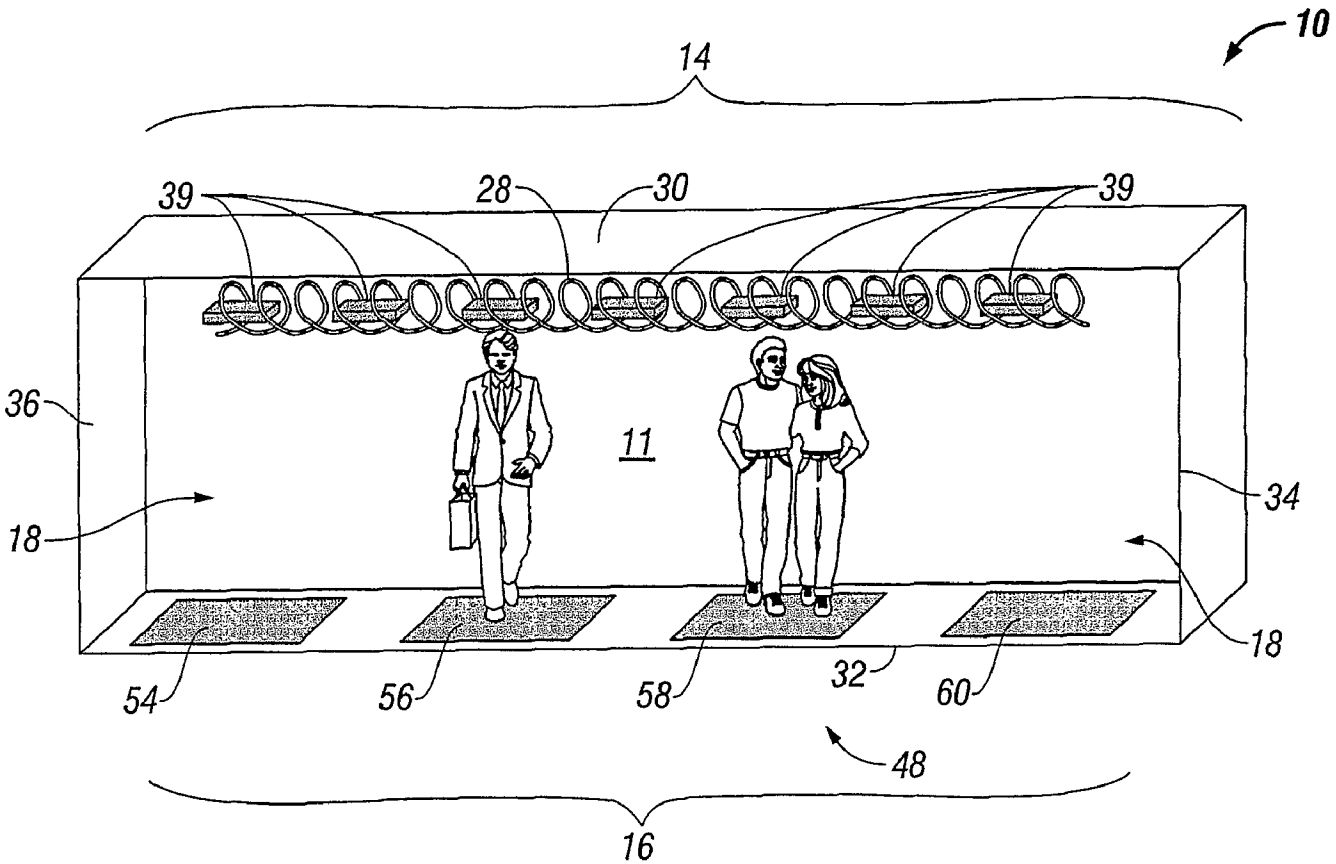
FIG. 3B is a perspective view of another electronic article surveillance antenna system for a wide entrance/exit.

Referring now to FIG. 3A, there is shown a modular EAS system 10 according to the present disclosure. As can be understood from the various figures (including FIG. 3A), the modular EAS system 10 complements a wide entrance or exit 11 as defined above and provides a magnetic field within interrogation zone 18. The interrogation zone 18 thus complements the size of the wide entrance/exit 11.

As is understood, typically the wide entrance/exit or protected space 11 is usually defined a top that is typically intersected by a ceiling collectively referred to as reference numeral 30 and a bottom intersected by a floor collectively referred to as reference numeral 32. The protected space 11 also has a first lateral side 34 and a second lateral side 36. The interrogation zone 18 extends across the particular space.

In one discussed embodiment, the modular EAS system 10 includes the first antenna system 14 with a first array 38 of transceiver antennas. The first array 38 may include any number of the core transceiver antennas 24 or more particularly four transceiver core antennas 40, 42, 44 and 46 configured as shown in FIG. 3A. In one embodiment, each of the transceivers of the first array 38 is spaced at about 2.8 meters from a centermost point of one transceiver to an adjacent centermost point of the next transceiver for an 11.4 meter entrance or exit. Various other configurations are possible and the present disclosure is not limited to any such arrangement.

Figure 5:
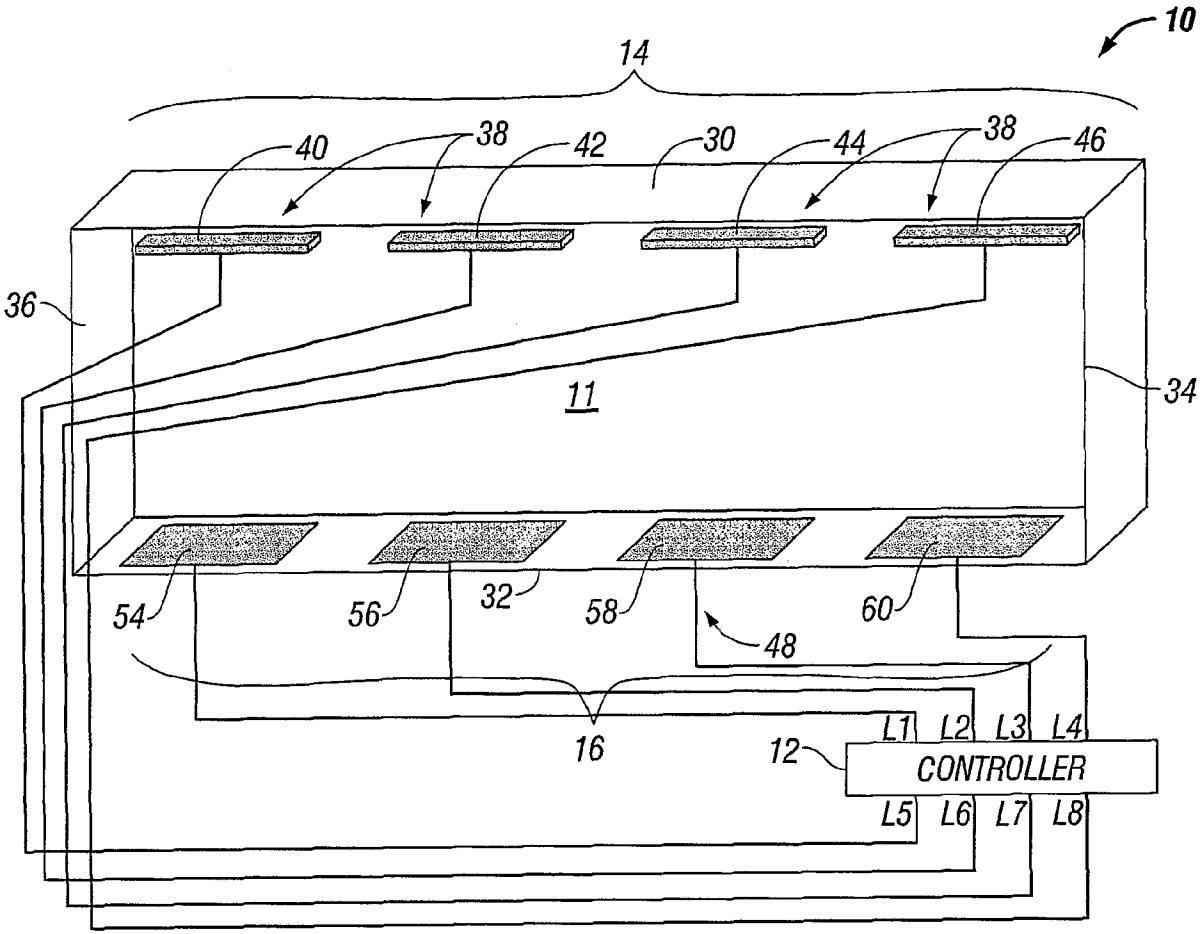
FIG. 5 is a schematic of the electronic article surveillance antenna system for a wide entrance/exit of FIG. 3A.

Each antenna of first array 38 of core transceiver antennas 40, 42, 44 and 46 is connected to the controller 12 as shown in FIG. 5. The controller 12 as shown in FIG. 2 may be separate from each core transceiver antenna 24, but also may be integrated with a pedestal or other suitable housing (not shown) of one of the core transceiver antennas or alternatively may have another separate housing. The controller 12 is a digital signal processor and includes proper control and switching functions to switch each of the core transceivers antennas 40, 42, 44, 46 in the first array 38 between a transmitting function and a receiving function at proper time intervals based upon one or more program instructions stored in a memory or that is input by a user.

Alternatively, each of the core transceiver antennas 40, 42, 44, 46 of the first array 38 may each have a separate transmitting antenna and a separate receiving antenna. Moreover, some antennas of the first array 38 may be switched to a transmitting function while at the same time a remainder of the rest of the first array 38 antennas may be switched to a receiving function by the controller 12. Various configurations are possible and within the scope of the present disclosure for the first array 38. In this aspect, the first array 38 is located in the ceiling 30 or overhead to extend across the protected area 11 and define the interrogation zone 18. The first array 38, alternatively, may be connected to the ceiling 30 at the top of the interrogation zone 18 and thus provide a visual deterrent to shoplifters.

Referring now again to FIG. 2, there is shown a perspective view of one of the core transceiver antennas 24 (of the number of transceivers) of the first array 38. In one embodiment, the first array 38 may have four of such core transceiver antennas 24 being spaced about 2.8 meters from one another from center to center. The core transceiver antenna 24 generally has the core 26 surrounded by a winding 28. The core 26 may be constructed from a variety of materials known in the art, such as ferrite or another amorphous magnetic material. The core 26 may also be constructed from a nanocrystalline material, as described in U.S. patent application Ser. No. 10/745,128, and U.S. patent application Ser. No. 10/855,203 which are both herein incorporated by reference in its entirely.

A nanocrystalline core antenna may include a plurality of ribbons of nanocrystalline material laminated together with suitable insulation coatings. The nanocrystalline material begins in an amorphous state achieved through rapid solidification techniques. After casting, while the material is still very ductile, a suitable coating such as silicone dioxide may be applied to the material.

This coating remains effective after annealing and prevents eddy currents in the laminate core 26. The material may be cut to a desired shape and bulk annealed to form the nanocrystalline state. The resulting nanocrystalline material exhibits excellent high frequency behavior up to the RF range, and is characterized by constituent grain sizes in the nanometer range. The term "nanocrystalline material" as used herein refers to material including grains having a maximum dimension less than or equal to 40 nm. Some materials have a maximum dimension in a range from about 10 nm to 40 nm. Various configurations are possible and within the scope of the present disclosure.

Some nanocrystalline materials useful in a nanocrystalline core transceiver antenna include alloys such as FeCuNbSiB, FeZrNbCu, and FeCoZrBCu. These alloys are commercially available under the names FINEMET, NANOPERM, and HITPERM, respectively. The insulation material or coating being disposed between the materials may be any suitable material that can withstand the annealing conditions, since it is preferable to coat the material before annealing. Epoxy may be used for bonding the lamination stack after the material is annealed. This also provides mechanical rigidity to the core assembly, thus preventing mechanical deformation or fracture. Alternatively, the nanocrystalline stack may be placed in a rigid plastic housing.

The windings 28 may include one or more coils being connected to the controller 12. When the controller 12 is acting in a transmitter mode or function, the controller 12 provides an excitation signal such as a drive current to the coil or windings 28. The windings 28 may have a non-uniform distribution about the length of the core. This distribution is in order to more efficiently utilize the magnetic core 26 and may be wound with a number of turns at an end and a number of different turns at another end for optimal operation. In one embodiment, the core 26 may have a first end having length A1 and a second end having length A2 and a center section having length A3 disposed between the first and second ends of the core 26 shown in FIG. 2.

The coil 28 may have a first ampere-turn concentration about the first end of the core 26 that is greater than, less than or the same as its ampere-turn concentration about the center portion of the core. Similarly, the coil or winding 28 may also have a second ampere-turn concentration about the second end of the core 26 that is greater than its concentration about the center portion of the core. Various configurations are possible and within the scope of the present disclosure.

As described in U.S. patent application Ser. No. 10/855,203 to Hall, et al., which is herein incorporated by reference in its entirety, the ampere-turn concentrations along the length of the core material 26 can be configured to achieve a desired or maximized magnetic flux density distribution along the core length. The required difference between ampere concentrations on portions of the core material 26 to achieve a desired or maximized magnetic flux distribution depends on system characteristics such as available transmitter power, core material 26 and dimensions, impedance at the core or a combination thereof. For the EAS system 10, the ampere-turns established by the windings 28 may be adjusted iteratively until a desired or maximized flux density is achieved for the protected space 11.

Referring again to FIG. 3B, the first array 38 may include a number of ferrite blocks 39 as the core material. Each of the ferrite blocks 39 may have a configuration being about one inch wide, and three inches long and about 0.6 inches in width. Each may be connected to one another for forming a chain like structure or module as the core material 26 shown in FIG. 2. The ferrite blocks 39 are known in the art and are disclosed in U.S. patent application Ser. No. 10/341,824 to Copeland, et al., which is herein incorporated by reference in its entirety. In one embodiment, the material may be a ferrite block 39 such as a Philips 3C90 soft ferrite block with a housing. A number of windings 28 as shown in FIG. 2 may be wound around each of the ferrite blocks 39 and be connected in series and parallel combinations to maximize power transfer and thus maximize a magnetic field distribution in the interrogation zone 18.

Referring again to FIG. 3A, each of the first array 38 of the first antenna system 14 is disposed in or on a ceiling 30 or in or on a false ceiling or housing that is connected to the ceiling 30. The first array 38 may be configured in any fashion in, or on the ceiling 30 and may, alternatively hang from the ceiling. In one embodiment, the first array 38 may include four core transceiver antennas 40, 42, 44, 46 with a low profile with each being separated from one another by about 2 meters when measured from a center to an adjacent center. Each transceiver antenna 40, 42, 44, 46 may be spaced laterally from one another on, in, or adjacent the ceiling 30 as shown so each of the core transceiver antennas 40, 42, 44, 46 is spaced substantially end to end to align over the protected space 11.

In this embodiment, the first array 38 includes first core transceiver antenna 40, second core transceiver antenna 42, third core transceiver antenna 44, and fourth core transceiver antenna 46. Each of the first array 38 may be connected to a separate controller 12 or all may be connected to one controller 12 by suitable leads. The first core transceiver antenna 40 is spaced a predetermined distance from the second core transceiver antenna 42 in a horizontal end to end fashion for maximum coverage of the interrogation zone 18 of the protected space 11. Likewise, the second core transceiver antenna 42 is also spaced a predetermined distance from the third core transceiver antenna 44 and the third and fourth core transceiver antennas 44, 46 are similarly arranged. In this manner, the first array 38 provides for coverage of virtually an entire length of the ceiling 30 across the protected space 11.

The modular EAS system 10 also has the second antenna system 16. The second antenna system 16 has a second array 48 of transceiver antennas. Each transceiver antenna of the first array 38 is disposed in complementary substantially vertical registration with each transceiver antenna of the second array 48. The second array 48 is disposed below the first array 38 as shown and is typically mounted on or atop a floor. In one embodiment, the second array 48 of transceiver antennas includes so-called "low profile" transceiver antennas 54, 56, 58, and 60.

Figure 4:
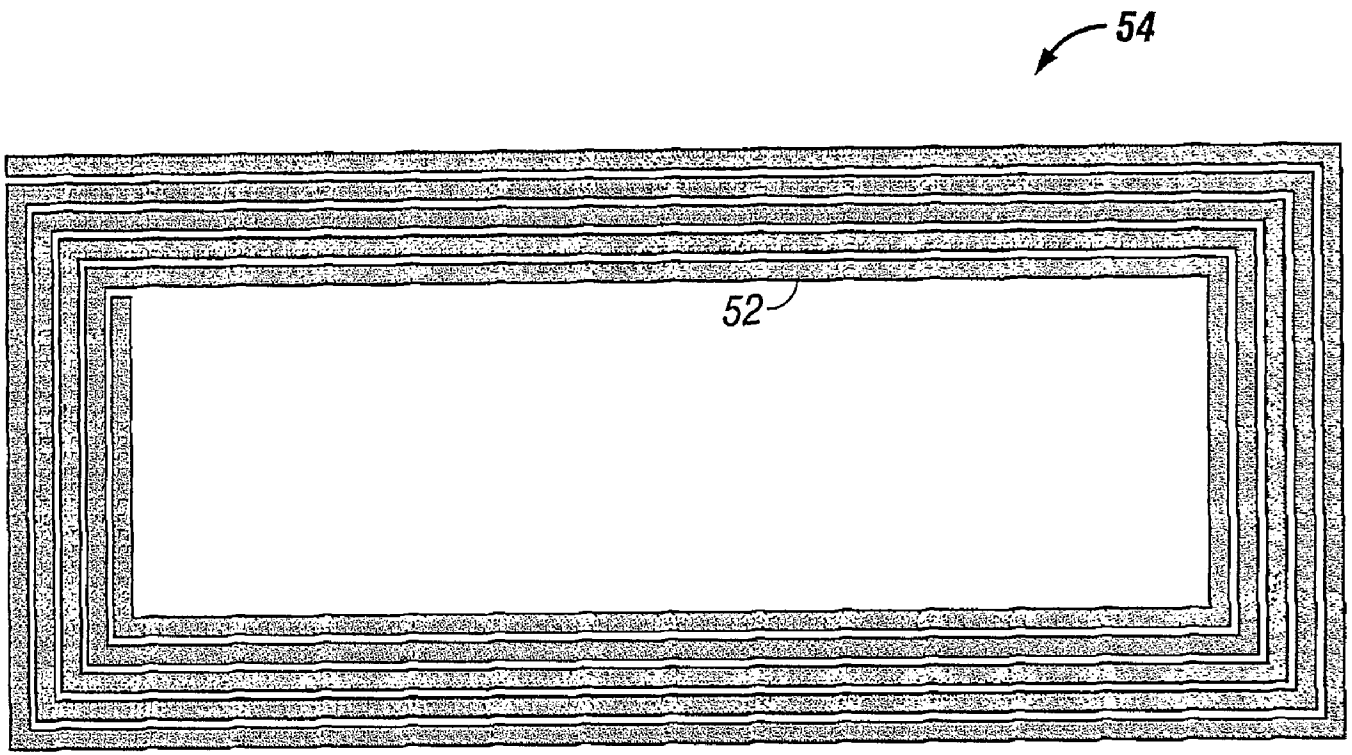
FIG. 4 is a top view of a wire loop antenna coil transceiver of FIG. 3A.

Referring now to FIG. 4, the transceiver antennas 54, 56, 58, 60 are each include a thin looped transmitter/receiving antenna 52. Each of the thin looped transmitter/receiving antennas 52 of the second array 48 is placed above ground in a floor or low profile structure. The housing may be a small and thin housing or mat or another suitable resilient member for housing the second lower array 38 of thin looped transmitter/receiving antennas 52. The floor may have a narrow width for allowing entrance or egress into the interrogation zone 18 by individuals without any disturbance. The floor also provides for an installation without any excavation of the sub floor. The floor may be a housing that is a movable structure that is replaceable and also may be firmly connected to the sub floor 32 to allow an individual to traverse over the floor without any difficulty and in a comfortable manner without the floor dislodging, or slipping relative to the sub floor.

Each of the thin looped transmitter/receiving antennas 52 is wound as shown in a coil configuration having a suitable number of turns. The thin looped transmitter/receiving antenna 52 is connected to the controller 12 and again has proper control and switching to switch between a transmitting and receiving functions at proper intervals. The number of turns of each of the thin looped transmitter/receiving antenna 52 of the second array 48 is sufficient to provide for a proper number of ampere-turns. The number is sufficient to deliver magnetic fields for a marker excitation in the transmitting function and also reliably detect the EAS marker 20 in the receiver cycle. In one embodiment, the thin looped transmitter/receiving antenna 52 has five turns. In another embodiment, the antenna 52 may have fifteen turns. Various antenna 52 with differently shaped turns or a different number of turns are also contemplated.

Each antenna coil transceivers 54 through 60 are disposed under a flooring or housing but above a sub floor or in a suitable low profile housing that allows the consumers to simply walk over without any obstruction. The antenna coil transceivers 54 through 60 and are suitably thin to allow an individual to comfortably traverse over the thin housing without being impeded or notice the EAS system 10.

The antenna coil transceivers 54, 56, 58, 60 are configured to act in transmitter and receivers modes or functions and are controlled by the controller 12. When functioning as transmitters, the magnetic field emitted by the antenna coil transceivers 54, 56, 58, 60 may oppose one another to establish a vertical component of a magnetic field in a centermost portion of an interrogation zone 18 and also provide magnetic field cancellation at a desired distance into the commercial space perpendicular to the interrogation zone. This configuration is designed to comply with applicable regulatory requirements and has low power consumption. When functioning in the receiving function, the wire loop antenna coil transceivers 54, 56, 58, 60 are designed to switch from an aiding mode to an opposing mode upon a control signal sent by the controller 12.

The first antenna system 14 has the first array 38 which provides a relatively strong magnetic field proximate thereto wherein the second array 48 is usually relatively weak. Likewise, the second antenna system 16 with the second array 48 provides a relatively strong magnetic field proximate thereto wherein the first antenna system 14 with the first array 38 is typically relatively weak.

The first through fourth wire loop antenna coil transceivers 54 through 60 are disposed and encompass the lower periphery of the interrogation zone 18. The first through fourth wire loop antenna coil transceivers 54 through 60 augments a vertical direction of the magnetic field and also a lateral direction of the magnetic field or a direction being perpendicular to an entrance or exit plane.

Referring now to FIG. 5, core transceiver antennas 40 through 46 are shown connected to the controller 12 with L1, L2, L3 and L4 representing the antenna loads respectively of the first through fourth core transceiver antennas 40 through 46. The first through fourth wire loop antenna coil transceivers 54 through 60 are also shown connected to the controller 12 with L5, L6, L7 and L8 representing the antenna loads, respectively, of the first through fourth wire loop antenna coil transceivers 54, 56, 58, 60.

Each of the transceiver antennas of the first through fourth core transceiver antennas 40 through 46 may be phase-switched to provide an optimal amount of detection performance such as described in U.S. Pat. No. 6,118,378 to Balch, et al., and U.S. patent application Ser. No. 10/037,337 to Copeland, et al. which are both incorporated by reference in their entirety. Additionally, each of the wire loop antenna core transceivers of the first through fourth 54, 56, 58, and 60 may also each be phase-switched to provide an optimal amount of detection performance.

It has been observed that an array of four transceiver antennas allows more phase modes and improved detection performance. The controller 12 can generate pulsed or continuous detection schemes including swept frequency, frequency hopping, frequency shift keying, amplitude modulation, frequency modulation, and other software algorithms depending on the EAS system 10 and protected space 11 sizes as recited in U.S. Pat. No. 6,118,378 to Balch, et al., which was herein previously incorporated by reference in its entirety.

Each of the first through fourth wire loop antenna coil transceivers 54 through 60 is selected with a predetermined number of loops to maximize efficiency. Some antenna coil transceivers 54 may have a different number of loops depending upon a particular purpose. The loops are sufficient so as to transmit during a transmit cycle a sufficient amount of magnetic energy to excite the marker 20, particularly at a point where the first array 38 is at a minimum intensity in the transmit function. The first through fourth wire looped antenna coil transceivers 54, 56, 58, and 60 also have a suitable number of turns so as to reliably detect the EAS marker 20, particularly at a point where the first array 38 is at a minimum intensity during the receiver mode or function.

Figure 6:
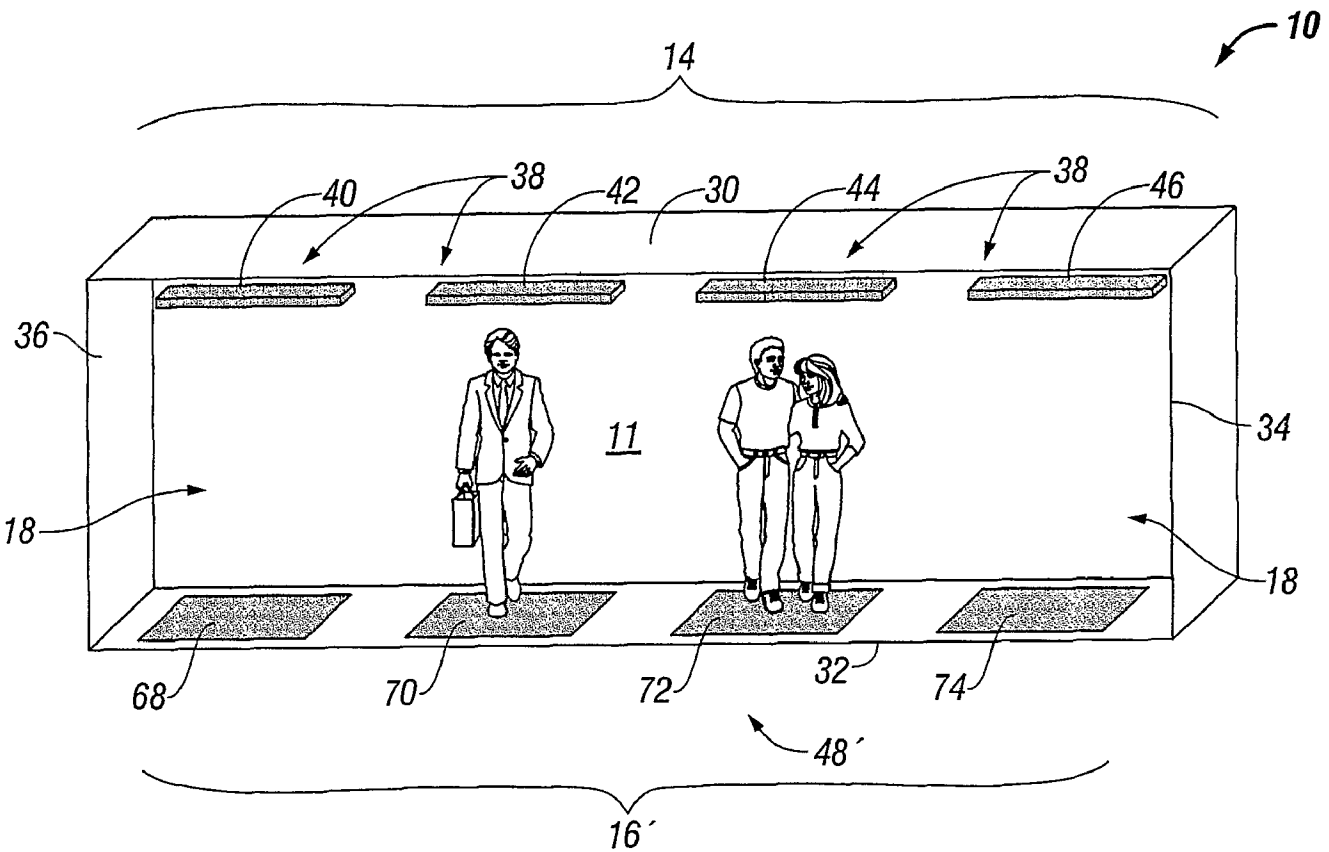
FIG. 6 is a perspective view of another embodiment of the electronic article surveillance antenna system for a wide entrance/exit.

Referring now to FIG. 6, there is shown another embodiment of the EAS system 10 of the present disclosure. In this embodiment, the EAS system 10 includes a similar first antenna system 14 with a different second antenna system 16'. The second array 48' includes a number of low profile surface mounted transceivers 68, 70, 72, 74. Each of the low profile surface mounted transceivers 68, 70, 72, 74 is mounted below the floor and above a sub floor on the bottom 32 of the protected space 11. The lower second array 48' has a first transceiver 68, a second transceiver 70, a third transceiver 72, and a fourth transceiver 74. Each is connected to the controller 12 and is configured for both operation in both transmit and receive functions as described previously.

Figure 7:
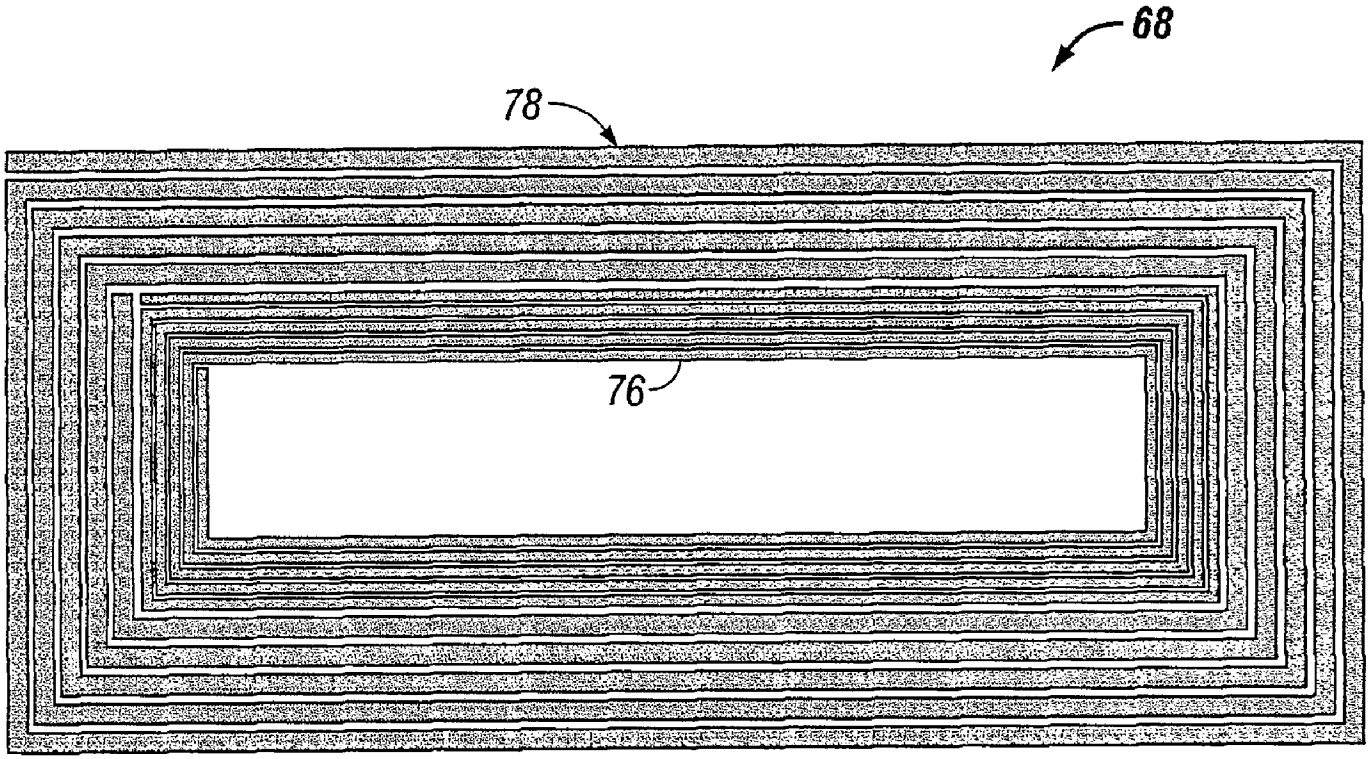
FIG. 7 is a top view of a transceiver having a wire loop antenna coil receiver and a transmitter of FIG. 6.

FIG. 7 shows one low profile surface mounted transceiver 66, e.g., transceiver 68, of the second lower array 48' which includes a receiver antenna coil 76. The receiver antenna coil 76 is wound in a number of loops and is coupled to the controller 12. The low profile surface mounted transceiver 68 also has another transmitter antenna coil 78. The transmitter antenna coil 78 is also connected to the controller 12. The transmitter antenna coil 78 is wound in a number of coil loops. The number, again, may be any number that is a sufficient number to transmit and deliver magnetic fields for an EAS marker 20 excitation. In one embodiment, the transmitter antenna coil 78 has five turns. The transmitter antenna coil 78 further has a centermost space. The receiver antenna coil 76 is conveniently in the centermost space to reliably detect the EAS marker 20 during the receiver cycle. In one embodiment, the receiver antenna coil 76 may include five turns.

Figure 8:
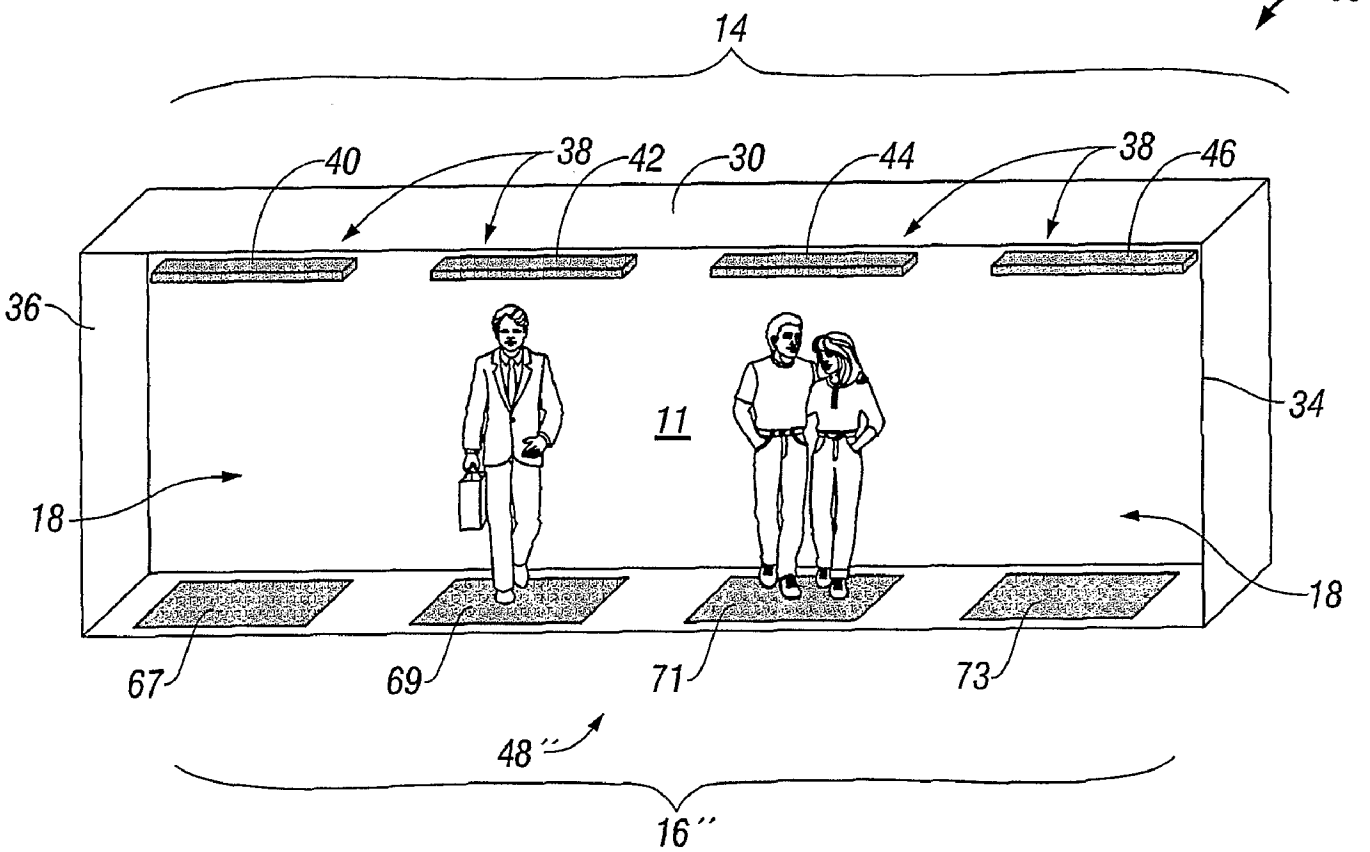
FIG. 8 is another perspective view of yet another embodiment of the electronic article surveillance antenna system for a wide entrance/exit.

Referring now to FIG. 8, there is shown another embodiment of the EAS system 10. In this embodiment, the second antenna system 16" has a lower second array 48" with first through fourth transceivers 67, 69, 71, and 73. The transceivers of the lower second array 48" are disposed beneath the bottom/floor 32 but above a sub floor of the protected space 11 to minimize installation costs. Each of the first through fourth transceivers 67, 69, 71, and 73 is a surface mount low profile transceiver antenna and is mounted above the sub floor in a suitable housing.

Figure 9:
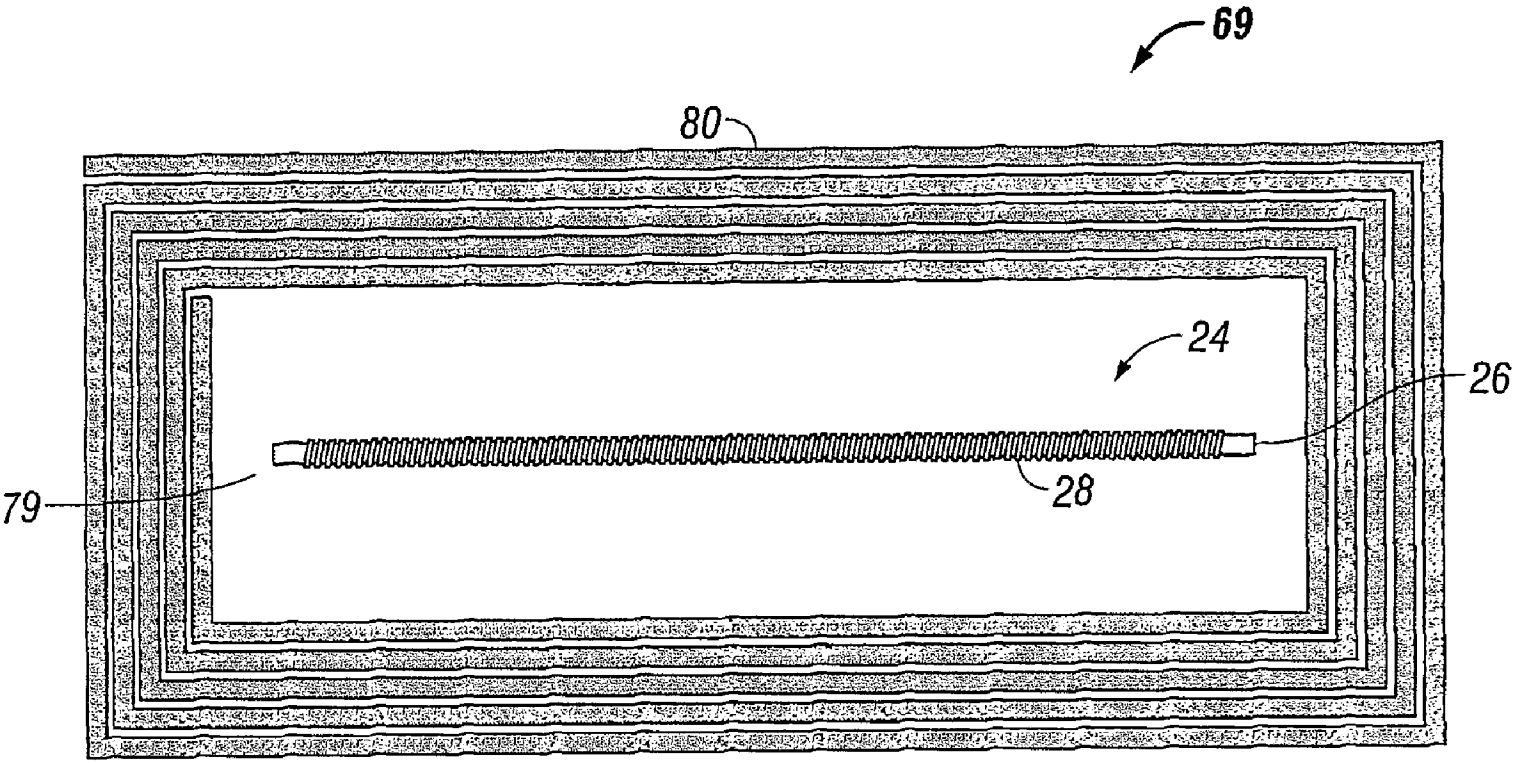
FIG. 9 is a top view of a transceiver having a core antenna receiver with a wire loop transmitter coil of FIG. 8.

FIG. 9 shows a top view of first transceiver 69 of the second lower array 48" of FIG. 8. The other surface mount low profile transceiver antennas of the second array 48 may have the same or a different configuration. The first transceiver 69 has a wire loop transmitter antenna 80 which is configured to have five turns which surround a core antenna receiver 24. The core antenna receiver 24 has a core material 26 with the number of windings 28 wound therearound as described previously.

The wire loop transmitter antenna 80 is configured to act as a transmitter and produces the magnetic field with sufficient predetermined intensity to excite the EAS marker 20. The wire loop transmitter antenna 80 cooperates with the second array 48" and the first array 38 in order to provide coverage of the interrogation area 18. The core antenna 24 is in the centermost portion 79 of the wire loop transmitter antenna 80 and is configured to act as a receiver and is connected and controlled by a control signal from the controller 12. The core antenna 24 delivers sufficient magnetic energy in order detect the EAS marker 20. The second lower array 48" has four sets of transceivers antennas disposed on the floor 32 which are suitably thin so as to be mounted with minimal obstruction. Alternatively, the second lower array 48" may be disposed above the sub floor in a suitable low-profile housing.

Figure 10:
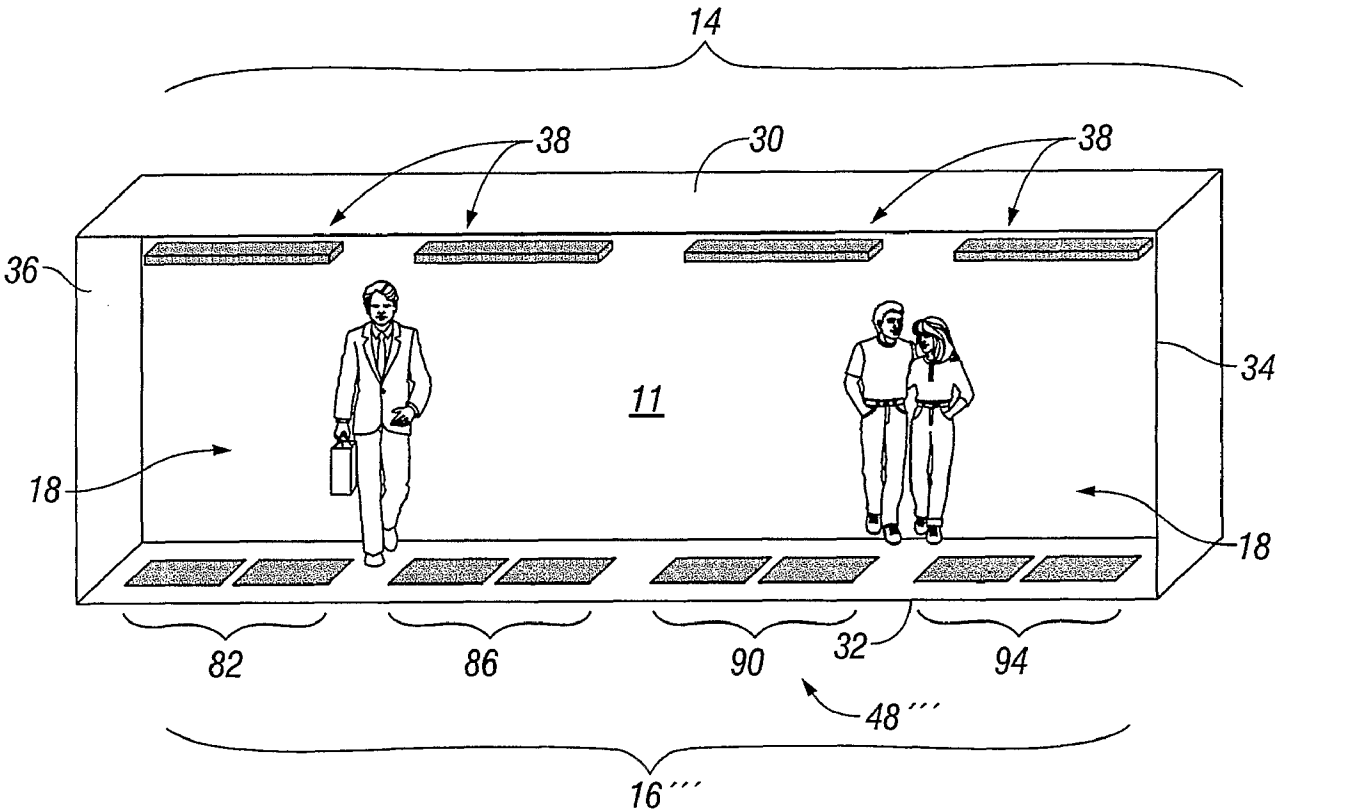
FIG. 10 is another perspective view of yet another embodiment of the electronic article surveillance antenna system for a wide entrance/exit.

Referring now to FIG. 10, there is shown still another embodiment of the EAS system 10. The EAS system 10 has the first array 38 that is similar to the other previously described embodiments. The EAS system 10 also has the second antenna system 16''' with the lower second array 48'''. In this embodiment, the lower array 48''' has a number of paired wire loop antenna coil transceivers. The lower array 48''' has a first transceiver antenna pair 82, a second transceiver antenna pair 86 and pairs 90 and 94. The lower array 48''' may have less or more transceiver antennas depending on a length of size of the protected space 11.

Each of the pairs of transceivers (or alternatively, each individual transceivers 82, 86, 90, 94) are controlled by the controller 12 and may operate in either the transmit or the receive mode. Each of the transceiver antennas 82 through 94 are surface mounted beneath a floor or in a housing and above the sub floor for an easy and quick installation.

Figure 11:
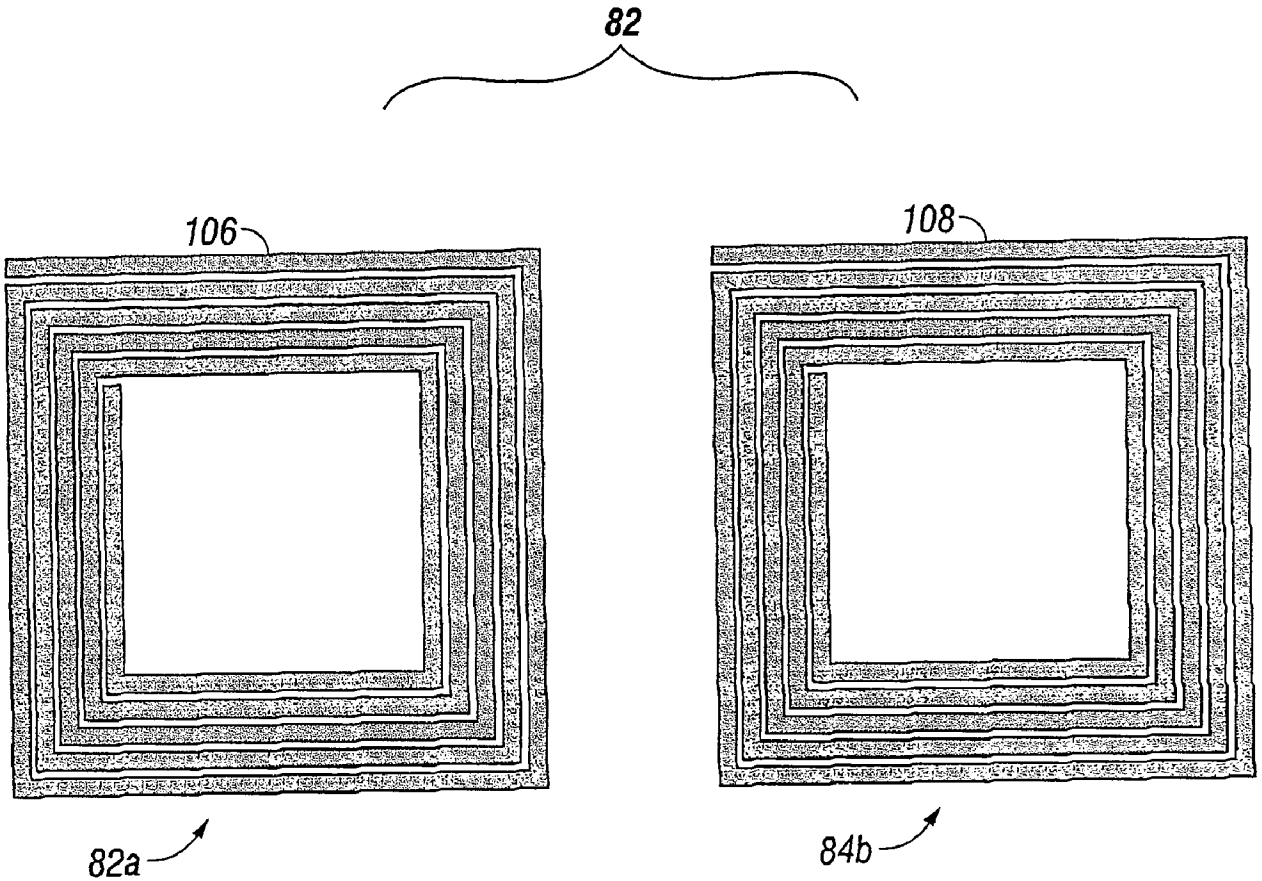
FIG. 11 is a top view of a pair or a first transceiver and a second transceiver of FIG. 10.

FIG. 11 shows a top view of the first pair 82 of the second lower array 48'''' which includes antenna coil transceivers 82*a* and 82*b* which are disposed adjacent one another along or under a floor on the bottom 32 of the protected space 11, but above a sub floor. Both the first wire loop antenna coil transceiver 82*a* and the second wire loop antenna transceiver 82*b* include wire loops 106 and 108 respectively which connect to controller 12. The controller 12 switches the first wire loop antenna coil transceiver 82*a* from a transmit function to a receive function and likewise may control and switch the second wire loop antenna coil transceiver 82*b* from transmit to receive functions.

The first wire loop antenna coil transceiver 82*a* in a first mode transmits an exciter pulse or a continuous exciter signal to excite an EAS marker 20 when the EAS marker 20 is in the interrogation zone 18. When the first wire loop antenna coil transceiver 82*a* is transmitting the pulse or signal, the second wire loop antenna coil transceiver 82*b* may be in another mode.

The second wire loop antenna coil transceiver 82*b* is also controllable in a second mode or a receiving mode. In the receiving mode, the second transceiver 82*b* receives the characteristic signal generated by the EAS marker 20 when the marker is in the interrogation zone 18.

Due to the fact that there exist a magnetic field cancellation between the first array 38 of first antenna system 14 and the second array 48''' of the second antenna system 16''', one or more null zones may arise. In addition to switching between transmit and receive modes, the controller 12 may also flip between transmitter phases when both the first and second wire loop antenna coil transceivers of pair 82 are in the transmit mode. A phase of each of the first wire loop antenna coil transceiver 82*a* and a phase of the second wire loop antenna coil transceiver 82*b* may also be controlled with phase control circuitry or program instructions in the controller 12 to independently reverse the phase of one of the pairs.

This may be particularly advantageous since, depending on the coil phase relationship, the EAS markers 20 in some locations of the interrogation zone 18 may not be adequately stimulated in order to produce a response from a saturated EAS marker 20 in the null zone. The controller 12 controls transmitter phasing of each of the first wire loop antenna coil transceiver 82*a* and second wire loop antenna coil transceiver 82*b* or another pair of the second array 48''' to alternate or cycle between aiding, in phase, opposing phase, and out of phase conditions.

This cycling can continue and thus the null zones may be moved from an initial location to an alternate location thus periodically eliminating the null zone. This cycling by the controller 12 may continue until such a time that the EAS marker 20 is first sensed. Thereafter, the controller 12 may authenticate the sensed presence of the EAS marker 20 using a suitable algorithm and then, upon such detection and authentication, sound the alarm 22. This is advantageous because this phase flipping per unit time reduces the amount of transmitter power required while increasing optimal field relationships between transmit and receive functions. This independent phasing switching or flipping is described in U.S. Pat. No. 6,118,378 to Balch, et al., which has been previously incorporated by reference in its entirety.

Figure 12:
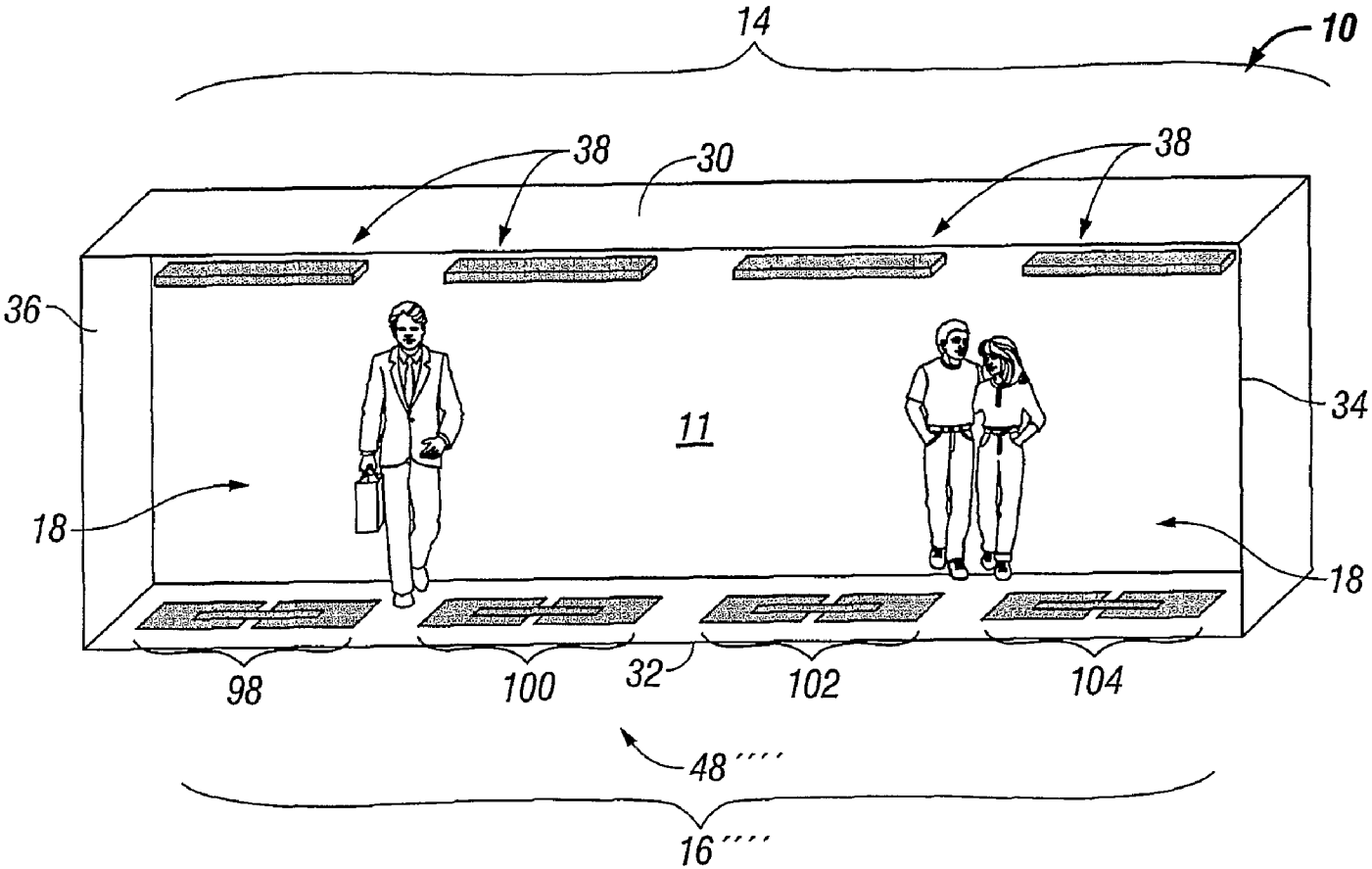
FIG. 12 is another perspective view of yet another embodiment of the electronic article surveillance antenna system for a wide entrance/exit.
Figure 13:
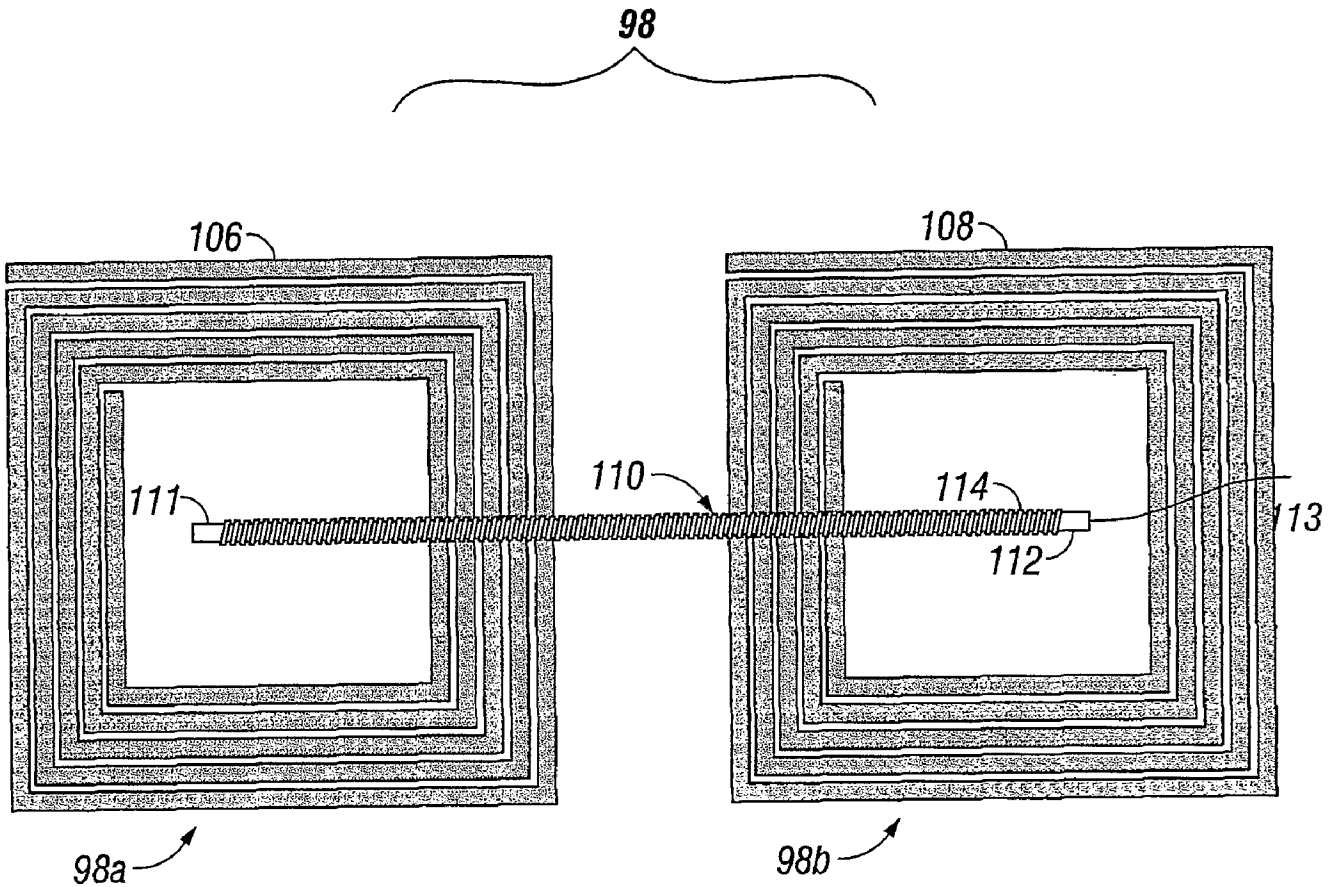
FIG. 13 is a top view of a first transmitter antenna and a second transmitter antenna having a core receiver antenna extending therebetween of FIG. 12.

FIG. 12 shows another envisioned EAS system 10 which includes the same or similar first antenna system 14 with the first array 38 and a second antenna system 16'''' with the second lower array 48''''. The second lower array 48'''' has transceivers pairs 98, 100, 102, and 104. FIG. 13 shows a top view of the first transceiver pair 98 and the other transceivers may be configured in the same or in a different configuration. The first transceiver pair 98 includes a first wire loop coil transmitter antenna 98*a* with a wire loop 106 and a second wire loop coil transmitter antenna 98*b* with a wire loop 108. The first and the second wire loops 106, 108 are connected to the controller 12. The controller 12 drives a control signal through the first and the second wire loops 106, 108 and each can be used for transmit functions in the EAS system 10.

Each of the wire loops 106, 108 is connected to an intersecting core antenna 110. The intersecting core antenna 110 is a receiver. The intersecting core antenna 110 is disposed length wise across or underneath the floor 32, but above a sub floor. The intersecting core antenna 110 has a first end 111 disposed in a centermost portion of the wire loop 106 and a second end 113 in a centermost portion 113 of the wire loop 108. The intersecting core antenna 110 has a core material 112 and a winding 114. The core material 112 may be a suitable ferrite or amorphous material with a very low profile. The core antenna receiver 110 is connected to the controller 12.

The controller 12 can control a phase and has the ability to reverse the phase of one of the wire loops 106, 108 in order to control the transmitter phasing. The controller 12 can thus alternate between aiding, or in phase, opposing, or out of phase relative phase conditions of the transceiver pairs in the second array 48'''' until the EAS marker 10 is sensed by the core antenna receiver 110 therebetween and extending across each pair. This alteration between aiding, or in phase, opposing, or out of phase relative phase conditions of the pairs in the second array 48'''' is advantageous. The alteration provides for phase canceling between a pair of adjacent transmitter antennas and provides for a dramatically increased power levels without exceeding regulatory limits for radiated electromagnetic field emissions. The controller 12, upon detecting the EAS marker 20 from the receiver 110, may hold a phase relationship fixed. The controller 12 may then hold the phase relationship until confirmation is determined by a suitable algorithm or method.

Figure 14:
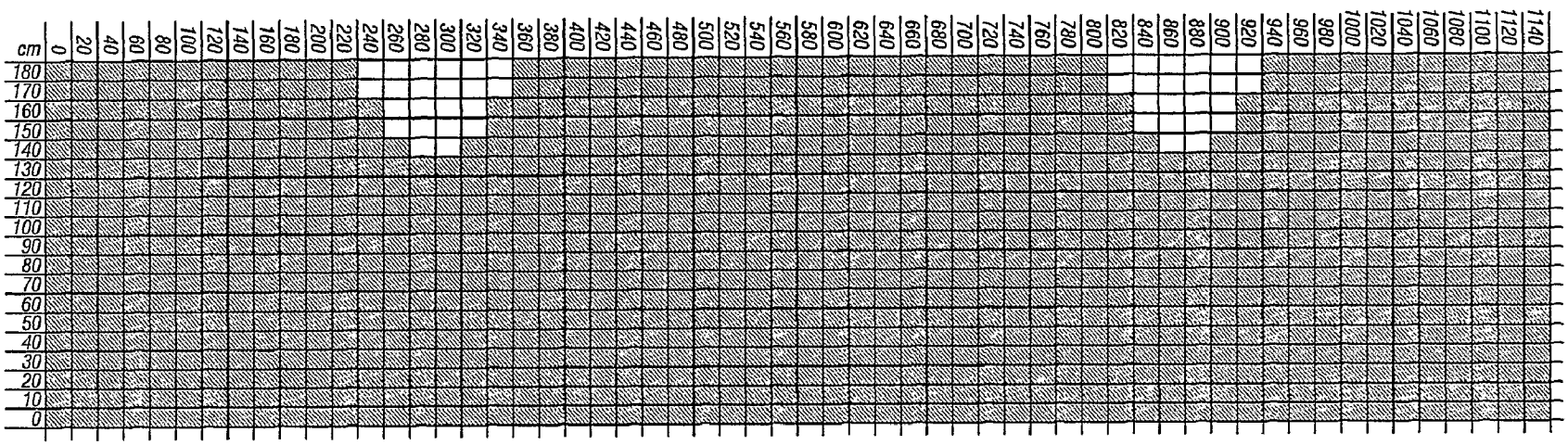
FIG. 14 is a plot of an EAS marker pick rate typical of the EAS system of FIG. 13.

Referring now to FIG. 14, there is shown a plot of the projected detection performance for and EAS electronic marker 20 for FIG. 13 with the protected space 11 being about 11.4 meters wide and 1.8 meters high. Testing generally results in an overall pick rate. The pick rate is an overall indication of a performance of the system or probability of how well the system can detect an EAS marker 20 in the interrogation zone 18. This particular design resulting in a pick rate with a probability of 96 percent detection of the marker. The shaded area of the figure shows detection of the EAS marker 20 while the unshaped region shows non-detection. One skilled in the art should appreciate the superior and unexpected performance of the EAS system 10 and the advantage of any relevant non-detection being at a level that is high above ground (above 1.6 meters) where few, if any markers will traverse therethrough.

Figure 15:
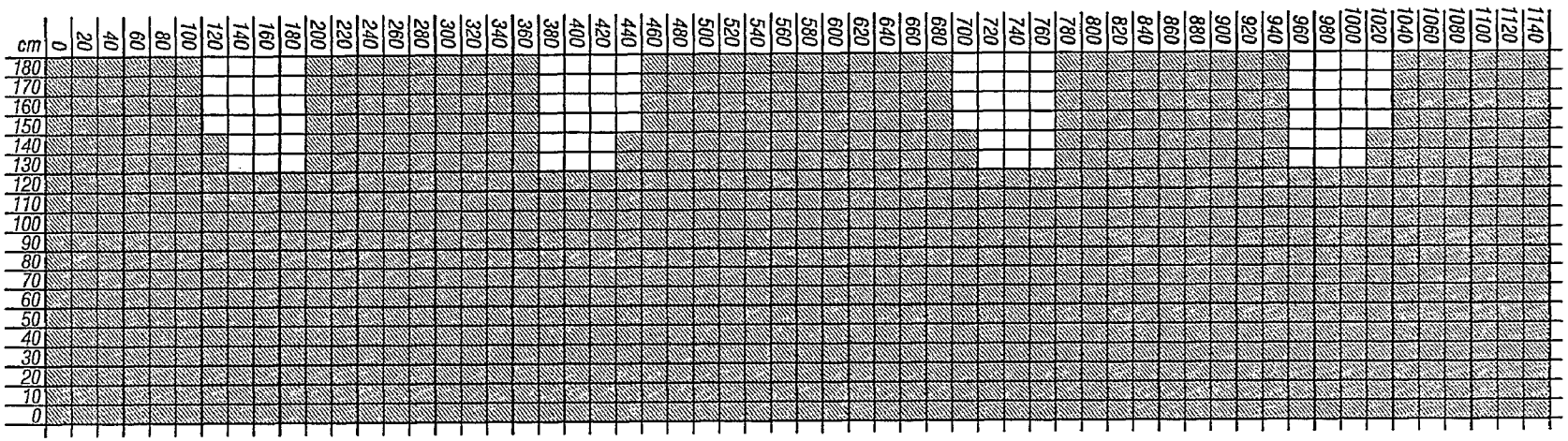
FIG. 15 is another plot of an EAS marker pick rate of FIG. 13 for another marker orientation.
Figure 16:
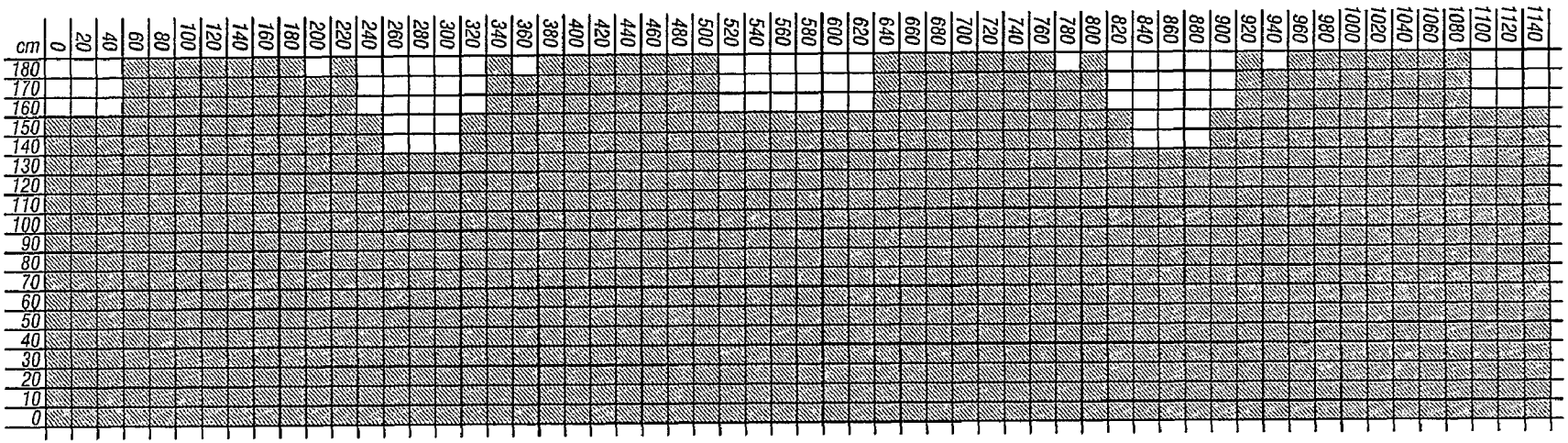
FIG. 16 is still another plot of an EAS marker pick rate of FIG. 13 for yet another orientation.

FIGS. 15 through 16 show a plot showing the projected detection of the EAS marker 20 in horizontal and lateral orientations with the embodiment being shown in FIG. 13. In the horizontal orientation shown in FIG. 15, the pick rate is 92 percent. In the lateral orientation shown in FIG. 16, the pick rate is 92.6 percent. Other not shown composite orientations yielded a pick rate at 93.5 percent. For comparison purposes, conventional EAS systems range from a pick rate of 68 percent to about 85 percent.

As can be appreciated, the EAS system 10 of the present disclosure may be configured in a modular manner. The modular configuration of the EAS system 10 is very effective for reducing installation costs. The modular configuration also prevents costly and labor intensive installation work necessary to install the EAS system 10. Moreover, the modular configuration allows the installer or operator of the retail establishment a certain degree of freedom when installing the EAS system. The installer or operator may change or move a design layout of the establishment to accommodate a number of differently sized entrances or exits, and then selectively configure the arrangement of the EAS system 10 in a complementary manner. Also, the modular EAS system 10 may be initially installed rapidly in an existing home or retail commercial establishment or a customized installation. The modular EAS system 10 prevents any invasive construction or removal of, for example, home or retail structures such as a concrete floor, dry wall or displays. Such construction may interrupt, for long periods of time, the enjoyment of the retail space and thus reduce productivity and decrease sales. Moreover, such an EAS system 10 is ideal for a retrofit installation application such as in a mall, library, commercial environment, residential environment, warehouse or another application.

Another significant advantage of the modular EAS system 10 is that it provides coverage of a wide interrogation zone with a consistent intensity sufficient to excite an electronic article surveillance marker 20. The modular EAS system 10 also provides the predetermined intensity sufficient for a number of spatial considerations throughout the interrogation zone 18. Sufficient intensity prevents "null zones" with little or no intensity while complying with known regulations and does not excite markers in other stationary locations for a false signal. The modular EAS system 10 provides excellent coverage for a wide entrance or exit.

The modular EAS system 10 also provides an interrogation zone 18 which is sufficiently intense and localized. This arrangement prevents falsely exciting markers 20 which trigger alarms because interrogation zone 18 is extending too far into the establishment. If not localized, this would result in many false events or false excitations. Such false events or excitation detracts from true instances when an item is actually, in fact, being removed. Additionally, the modular EAS system 10 provides compliance with relevant regulatory requirements for electromagnetic field emissions, health and safety.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances. The embodiments described with reference to the attached drawing figures are presented only to demonstrate certain examples of the disclosure. Other elements, steps, methods and techniques that are insubstantially different from those described above and/or in the appended claims are also intended to be within the scope of the disclosure.

What is claimed is:

1. An electronic article surveillance antenna system with wide interrogation zones, the system comprising:

a plurality of core transceiver antennas with each of said plurality of core transceiver antennas connectable to a transmitter, said plurality of core transceiver antennas being adapted and configured to be installed adjacent a ceiling of the wide interrogation zone, said plurality of core transceiver antennas generating an interrogation signal into the wide interrogation zone, said plurality of core transceiver antennas each being connectable to a receiver to receive and detect of a response signal from an electronic surveillance marker disposed in the wide interrogation zone;

a plurality of transceiver antenna coils with each of said plurality of transceiver antenna coils connectable to said transmitter, said plurality of transceiver antenna coils being adapted to be installed adjacent a floor of the wide interrogation zone, said plurality of transceiver antenna coils generating said interrogation signal into the wide interrogation zone, said plurality of transceiver antenna coils each being connectable to said receiver and receiving and detecting said response signal from said electronic surveillance marker disposed in the wide interrogation zone;

wherein the plurality of core transceiver antennas and the plurality of transceiver antenna coils complement one another to cover the entire interrogation zone.

2. The system of claim 1, wherein said plurality of core transceiver antennas are each a plurality of ferrite core transceiver antennas.

3. The system of claim 1, wherein said plurality of core transceiver antennas are four core transceiver antennas with each of the four being disposed end to end along the wide interrogation zone.

4. The system of claim 1, wherein said plurality of transceiver antenna coils are four transceiver antenna coils with each of the four being disposed adjacent one another along the wide interrogation zone.

5. The system of claim 1, wherein at least one of said plurality of transceiver antenna coils has a wire loop antenna coil transceiver having a plurality of turns.

6. The system of claim 1, wherein at least one of said plurality of transceiver antenna coils has a first receiver coil and a second transmitting coil with each having a plurality of turns.

7. The system of claim 1, wherein at least one of said plurality of transceiver antenna coils has a wire loop antenna coil transmitter and a core antenna receiver.

8. The system of claim 1, wherein said plurality of transceiver antenna coils form a plurality of pairs, a first and a second of said pair alternating generating a first magnetic field and a second magnetic field substantially in phase with one another and out of phase with one another.

9. The system of claim 8, wherein said first magnetic field and said second magnetic field substantially in phase with one another and out of phase with one another move a null zone in said interrogating zone from a first location to a second location.

10. The system of claim 1, wherein said plurality of transceiver antenna coils has a first wire loop antenna coil transceiver and a second wire loop antenna coil transceiver, said first wire loop antenna coil transceiver being adjacent said second wire loop antenna coil transceiver, and wherein the system further has a core antenna receiver, said core antenna receiver extending across said first wire loop antenna coil transceiver and a second wire loop antenna coil transceiver.

11. The system of claim 1, further comprising a drive unit configured to selectively output a current through said plurality of core transceiver antennas and through said plurality of transceiver antenna coils and generating a magnetic field generally in a direction generally orthogonal therefrom, wherein said plurality of transceiver antenna coils and said plurality of ferrite core transceiver antennas are dispersed in a modular fashion around said interrogation zone.

12. The system of claim 1, wherein at least some of said plurality of transceiver antenna coils are disposed below a housing and above a sub floor.

13. The system of claim 1, wherein said plurality of core transceiver antennas are ferrite core transceiver antennas, and are disposed above said plurality of transceiver antenna coils.

14. The system of claim 11, wherein said magnetic field is complementary in size to said interrogation zone.

15. An electronic article surveillance antenna system with a wide interrogation zone that is in excess of two meters in width, the system comprising:

a plurality of core transceiver antennas with each of said plurality of core transceiver antennas connectable to a transmitter, said plurality of core transceiver antennas each having a ferrite material with a winding, each of said plurality of core transceiver antennas being adapted and configured to be installed in a proximal location in or adjacent a ceiling of the wide interrogation zone, said plurality of core transceiver antennas generating an interrogation signal into the wide interrogation zone, said plurality of core transceiver antennas each being connectable to a receiver receiving and detecting of a response signal from an electronic surveillance marker disposed in the wide interrogation zone;

a plurality of transceiver antenna coils with each of said plurality of transceiver antenna coils connectable to said transmitter, each of said plurality of transceiver antenna coils being disposed under said plurality of core transceiver antennas, said plurality of transceiver antenna coils being adapted and configured to be installed adjacent or in a floor of the wide interrogation zone, said plurality of transceiver antenna coils generating said interrogation signal into the wide interrogation zone, said plurality of transceiver antenna coils each being connectable to said receiver to receive and detect said response signal from said electronic surveillance marker disposed in the wide interrogation zone;

wherein the plurality of core transceiver antennas and the plurality of transceiver antenna coils complement one another to cover the entire interrogation zone.

16. The electronic article surveillance antenna system of claim 15, wherein said plurality of transceiver antenna coils when transmitting, alternately generate a first and a second magnetic field being substantially in phase with one another and substantially out of phase with one another.

17. The electronic article surveillance antenna system of claim 16, further comprising a controller configured to receive and evaluate an output of said plurality of core transceiver antennas and said plurality of transceiver antenna coils for said response signal of said electronic surveillance marker disposed in the wide interrogation zone, said controller controlling said plurality of core transceiver antennas and said plurality of transceiver antenna coils in response thereto.

18. The electronic article surveillance antenna system of claim 16, wherein said plurality of core transceiver antennas and said plurality of transceiver antenna coils are disposed in a modular fashion around the wide interrogation zone.

19. The electronic article surveillance antenna system of claim 16, wherein said plurality of core transceiver antennas are arranged end to end in a complementary location to a ceiling.

20. The electronic article surveillance antenna system of claim 16, wherein said plurality of transceiver antennas coils are arranged laterally adjacent to each other in a complementary location to a floor.

21. The electronic article surveillance antenna system of claim 16, wherein said plurality of core transceiver antennas are arranged end to end in a complementary location to a floor, and wherein said plurality of transceiver antennas coils are arranged laterally adjacent to each other in a complementary location to a ceiling.

22. A method of detecting a marker in wide interrogation zones, the method comprising:

providing a plurality of core transceiver antennas with each of said plurality of core transceiver antennas connectable to a transmitter and a receiver;

placing said plurality of core transceiver antennas adjacent a ceiling of the wide interrogation zone;

providing a plurality of transceiver antenna coils with each of said plurality of transceiver antenna coils connectable to said transmitter and said receiver, placing said plurality of transceiver antenna coils adjacent a floor of the wide interrogation zone;

generating the interrogation signal into the wide interrogation zone using said plurality of transceiver antenna coils and said plurality of core transceiver antennas, said interrogation signal configured to receive and detect a response signal from the marker disposed in the wide interrogation zone; and covering the entire wide interrogation zone with the interrogation signal by said plurality of core transceiver antennas and said plurality of transceiver antenna coils complementing one another.

* * * * *